US011365869B2

(12) United States Patent
Holtrup et al.

(10) Patent No.: US 11,365,869 B2
(45) Date of Patent: Jun. 21, 2022

(54) LIGHTING DEVICE COMPRISING SPRING ELEMENT

(71) Applicant: Lumileds LLC, San Jose, CA (US)

(72) Inventors: Matthias Holtrup, Aachen (DE); Marcus Jozef Henricus Kessels, Aachen (DE)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/705,766

(22) Filed: Dec. 6, 2019

(65) Prior Publication Data

US 2020/0182438 A1 Jun. 11, 2020

(30) Foreign Application Priority Data

Dec. 10, 2018 (EP) ..... 18211298

(51) Int. Cl.
*F21V 17/16* (2006.01)
*F21K 9/20* (2016.01)
(Continued)

(52) U.S. Cl.
CPC ..... *F21V 17/162* (2013.01); *F21K 9/20* (2016.08); *F21S 41/141* (2018.01);
(Continued)

(58) Field of Classification Search
CPC .. F21V 17/04; F21V 17/06; F21V 17/16–168; F21S 41/196
See application file for complete search history.

(56) References Cited

U.S. PATENT DOCUMENTS

2014/0355286 A1 12/2014 Arita
2015/0266407 A1 9/2015 Rubia Mena et al.
(Continued)

FOREIGN PATENT DOCUMENTS

CN 102102838 A 6/2011
EP 2921770 A2 9/2015
(Continued)

OTHER PUBLICATIONS

EP18211298.7, "Extended European Search Report," dated May 27, 2019, 7 pages.
(Continued)

*Primary Examiner* — Sean P Gramling

(57) ABSTRACT

The invention refers to a lighting device (18) comprising a light-emitting module (2) and an optical system. The optical system comprises a first reference face (16), wherein the first reference face (16) is configured to accommodate the light-emitting module (2); and at least one spring element (20) is provided for fixing the light-emitting module (2) to the optical system in a clamping position, wherein the at least one spring element (20) comprises a first spring section (26) configured to exert a spring force in a first spatial direction ($f_1$) towards the first reference face (16) in the clamping position, wherein the at least one spring element further comprises a second spring section (28) configured to exert a spring force towards a second spatial direction ($f_2$) in the clamping position, and wherein the second spatial direction ($f_2$) is different from the first spatial direction ($f_1$). The invention further relates to a method for fixing a light-emitting module (2) to an optical system.

20 Claims, 8 Drawing Sheets

(51) Int. Cl.

| | |
|---|---|
| ***F21S 43/37*** | (2018.01) |
| ***F21S 43/14*** | (2018.01) |
| ***F21S 43/27*** | (2018.01) |
| ***F21S 41/141*** | (2018.01) |
| ***F21S 41/29*** | (2018.01) |
| ***F21S 45/47*** | (2018.01) |
| ***F21S 41/39*** | (2018.01) |
| ***F21S 41/19*** | (2018.01) |

(52) U.S. Cl.
CPC ..... *F21S 41/196* (2018.01); *F21S 41/29* (2018.01); *F21S 41/39* (2018.01); *F21S 43/14* (2018.01); *F21S 43/27* (2018.01); *F21S 43/37* (2018.01); *F21S 45/47* (2018.01)

(56) References Cited

U.S. PATENT DOCUMENTS

| | | | |
|---|---|---|---|
| 2017/0138550 | A1 | 5/2017 | Willwohl et al. |
| 2018/0031194 | A1 | 2/2018 | Seiger et al. |
| 2019/0204528 | A1* | 7/2019 | Oshima ..... F21V 17/162 |

FOREIGN PATENT DOCUMENTS

| | | | |
|---|---|---|---|
| JP | 2008288221 | A | 11/2008 |
| WO | 2013072812 | A1 | 5/2013 |
| WO | 2014083123 | A1 | 6/2014 |

OTHER PUBLICATIONS

From the EPO as the ISA, Notification of Transmittal of the International Search Report and the Written Opinion of the International Searching Authority, or the Declaration, PCT/EP2019/083320, dated Feb. 24, 2020, 13 pages.

* cited by examiner

LIGHTING DEVICE COMPRISING SPRING ELEMENT

CROSS REFERENCE TO RELATED APPLICATIONS

This application claims priority to European Patent Application No. 18211298.7 filed on Dec. 10, 2018, and titled "LIGHTING DEVICE COMPRISING SPRING ELEMENT," which is incorporated herein by reference.

FIELD OF THE INVENTION

The present disclosure relates to a lighting device comprising a light-emitting module being mounted in an optical system such as a reflector system, in particular in the area of automotive lighting.

BACKGROUND OF THE INVENTION

Lighting devices for automotive applications such as automotive headlights or taillights typically comprise an optical system such as a reflector system and/or lens system. The optical system produces a specific beam shape and illumination pattern, e.g. by focusing and/or collimating the light emitted by a light-emitting module.

The light-emitting module is configured as replaceable element in the optical system, wherein the light-emitting module is mounted in a releasable manner in the optical system. The light-emitting module may be fixed to the optical system by means of screws or may alternatively be riveted to the optical system.

For many applications, mounting the light-emitting module requires a precise positioning relative to the optical system to ensure that the desired beam shape is reliably obtained. However, a reliable mounting and reproducible positioning of the light-emitting module by means of a threaded connection, e.g. by means of screws or nuts, is difficult. The exact positioning of the light-emitting module relative to the optical system may critically depend on the torque applied when fixing the threaded connection, leading to a possible misalignment of the light-emitting module relative to the optical system.

Another difficulty in the positioning of the light-emitting module is caused by thermal effects. The thermal expansion of a light-emitting module that is fixed on one or more points by means of a threaded connection may lead to a temperature-dependent displacement and/or distortion of the light-emitting module relative to these fixed points. Thermal stresses may also occur due to differences in thermal expansion between the light-emitting module and the optical system. Hence, the alignment of light-emitting module and optical system may suffer from temperature effects such as a heating up during operation of the lighting device.

In the prior art, attempts have been made to mount light-emitting elements by means of a spring force.

WO 2013/072812 A1 relates to tension-providing clamps being used to attach a light-emitting assembly to a submount.

US 2017/0138550 A1 relates to a light-emitting diode (LED) package for use in a lamp comprising a cover for covering, at least partially, electrical components connectable to the LED. The cover comprises protrusions that may be spring-loaded to be received by a housing.

However, the means for fixing a light-emitting module to an optical system may still be further improved, in particular in lighting devices with high heat loads such as automotive lighting devices.

SUMMARY OF THE INVENTION

It is an object of the present invention to provide a lighting device that allows for a simple and reliable mounting of a light-emitting module in an optical system, wherein the positioning of the light-emitting module relative to the optical system is well-defined. The lighting device may also provide for a high thermal stability of the positioning. The invention further relates to a method for fixing a light-emitting module to an optical system.

According to a first aspect of the present invention, a lighting device is provided, comprising: a light-emitting module; an optical system comprising a first reference face, wherein the first reference face is configured to accommodate the light-emitting module; and at least one spring element for fixing the light-emitting module to the optical system in a clamping position, wherein the at least one spring element comprises a first spring section configured to exert a spring force in a first spatial direction towards the first reference face in the clamping position, wherein the at least one spring element further comprises a second spring section configured to exert a spring force towards a second spatial direction in the clamping position, and wherein the second spatial direction is different from the first spatial direction.

According to a second aspect of the present invention, a method for fixing a light-emitting module to an optical system is provided, the method comprising: arranging the light-emitting module on a first reference face of the optical system; fixing the light-emitting module to the optical system by bringing at least one spring element into a clamping position, wherein a first spring section of the at least one spring element exerts a spring force in a first spatial direction towards the first reference face in the clamping position, wherein a second spring section of the at least one spring element exerts a spring force towards a second spatial direction in the clamping position, and wherein the second spatial direction is different from the first spatial direction.

Exemplary embodiments of the invention may have one or more of the properties described below.

The light-emitting module may comprise at least one light-emitting element based on a semiconductor. The at least one light-emitting element may be mounted on a carrier material, e.g. a heat sink. The carrier material may be planar at least in sections, wherein the planar shape may be configured to abut to the first reference face of the optical system. The first reference face may also be planar at least in sections. A circuit board such as a printed circuit board may be provided in the light-emitting module for electrical contact. The light-emitting module may comprise a light-emitting face that is arranged on a side of the light-emitting module facing the first reference face or facing away from the first reference face.

The optical system may comprise primary and secondary optical elements for shaping the light emitted by the light-emitting module into a beam with a predetermined beam shape and intensity distribution. The optical system may comprise reflective and/or refractive elements. For instance, the optical system may comprise a reflector system such as a reflecting cup, at least one (pre-) collimator, at least one lens and/or at least one diffusor. The optical system may be specifically adapted to the light-emitting module in that a specific emission profile and a specific position of the light-emitting module is required in order to obtain a desired beam shape.

According to the invention, at least one spring element for fixing the light-emitting module to the optical system is provided. The at least one spring element may be brought into a clamping position, in which the light-emitting module is fixed to the optical system, in particular such that a releasable connection of the light-emitting module and the optical system is obtained by means of the at least one spring element. The spring element may be formed from an elastic material, for example from a metallic material. In some embodiments, the spring element may be made from wire material.

The spring element comprises a first spring section configured to exert a spring force in a first spatial direction towards the first reference face in the clamping position. By exerting the spring force along the first spatial direction, the light-emitting module is forced against the first reference face of the optical system, such that the light-emitting module is brought into a defined position in the first spatial direction. In particular, as described above, the first reference face of the optical system may be planar at least in sections, wherein the first spatial direction may be defined by the normal direction to the plane of the first reference face. For example, the first spatial direction may substantially coincide with the orientation of a light-emitting face of the light-emitting module.

Further, the at least one spring element comprises a second spring section configured to exert a spring force towards a second spatial direction in the clamping position. Therefore, the exertion of the spring force towards the second spatial direction brings the light-emitting module into a defined position relative to the second spatial direction, the second spatial direction being different from the first spatial direction. That is, the at least one spring element is configured to define the position of the light-emitting module to the optical system in the first and second spatial directions, wherein the first and second spatial directions are different. The first and second spatial directions form an angle to each other that is different from 0° and 180°.

Hence, compared to spring elements that only fix the light-emitting element along a single spatial direction and which for example rely on a friction fit in other spatial directions, the at least one spring element of the lighting device according to the invention advantageously utilizes spring forces along two spatial directions to reliably position the light-emitting module. Therefore, conventional fixing means such as screws or rivets may be omitted in the lighting device. Further, as the position of the light-emitting module is controlled along at least two spatial directions by spring forces, thermal stresses in the lighting device may be compensated by the spring element, minimizing or even preventing an undesired displacement and/or distortion of the light-emitting module relative to the optical system due to changes in temperature.

In an exemplary embodiment according to the invention, the first spatial direction and the second spatial direction are oriented substantially perpendicular to each other. By this, the positioning of the light-emitting module is particularly reliable.

In some embodiments, the at least one spring element may exert a spring force also along further spatial directions, for example, a third spatial direction. The first, second, and third spatial direction may form a mutually orthogonal arrangement, such that the light-emitting module is positioned along all three spatial directions by spring forces.

In another exemplary embodiment according to the invention, the first reference face is oriented substantially parallel to a light-emitting face of the light-emitting module. As described above, the light-emitting module may be in contact with the first reference face, wherein for example a carrier material abuts the first reference face. By this, when the spring element aligns the light-emitting module to the first reference face in the clamping position by means of the first spring section, the height of the light-emitting face of the light-emitting module relative to the optical system is aligned.

In another exemplary embodiment according to the invention, a second reference face is provided, wherein in particular the second spring section and/or the light-emitting module is in contact to the second reference face when the light-emitting module is fixed to the optical system. The second reference face has a spatial orientation that is different from the orientation of the first reference face, wherein for example the surface normals of the first and second reference faces are arranged perpendicular to each other. Hence, similar to the first reference face, the second reference face may be used to reliably align the light-emitting module relative to the optical system along the second spatial direction.

In another exemplary embodiment according to the invention, the optical system comprises at least one through-hole and the light-emitting module comprises at least one mounting element; and/or the light-emitting module comprises at least one through-hole and the optical system comprises at least one mounting element. The at least one mounting element is configured to engage the at least one through-hole when the light-emitting module is fixed to the optical system. That is, the light-emitting module and the optical system may have corresponding elements for engagement, optionally in a form fit, wherein the elements facilitate mounting the light-emitting module.

Further, the at least one mounting element may comprise a receptacle for the at least one spring element. The receptacle may for instance provide a form fit for the at least one spring element, such that a section of the at least one spring element may assume a fixed position relative to the mounting element.

In another exemplary embodiment according to the invention, the at least one spring element is configured to be locked on the light-emitting module and/or the optical system. In particular, the at least one spring element may be locked in a receptacle of at least one mounting element. That is, the spring element may for instance be elastically and optionally plastically deformed to bring the spring element into the clamping position, wherein the spring element is locked into the receptacle, for example by a form fit and/or by spring force. Hence, the spring element is securely held in the clamping position.

In another exemplary embodiment according to the invention, the at least one spring element is configured to be inserted into a pivot point on the optical system and/or the light-emitting module in an insertion position, and the at least one spring element is configured to be rotated around the pivot point from the insertion position into the clamping position. By providing an insertion position, mounting of the light-emitting module is facilitated further. With the rotation around the pivot point, a tensioning of the spring element can be obtained in a particularly simple manner. Optionally, the spring element may be locked into the clamping position after the rotation.

In another exemplary embodiment according to the invention, the at least one spring element further comprises a third spring section configured to exert a spring force substantially antiparallel to the second spatial direction. That is, while the light-emitting module may be aligned along the first spatial direction by means of the first reference face and the spring force along the first spatial direction, the light-emitting module may be aligned along the second spatial direction by means of a combination of the spring forces of the second and third spring sections, which spring forces are directed substantially antiparallel to each other. The light-emitting module is then held along the second spatial direction by means of opposing spring forces, which may be particularly advantageous for the compensation of thermal stresses. Optionally, the light-emitting module may be positioned along a third spatial direction, which is different from the first and second spatial directions, in a similar manner by opposing spring forces.

In another exemplary embodiment according to the invention, the light-emitting module comprises at least one LED, in particular at least one LED arranged on a carrier material. The LED may comprise at least one semiconductor element such as a p-n-junction, a diode, and/or a transistor. The LED may be provided as LED package, for example in conjunction with a substrate, lead frame and/or wire bonds. The carrier material may form a heat sink. Besides dissipating heat from the LED, the carrier material may also provide contact surfaces for the first reference face and/or the at least one spring element.

By means of the at least one spring element, the light-emitting module may be positioned and fixed to the optical system reliably without further connection means. Accordingly, in an embodiment of the invention, the light-emitting module is fixed to the optical system only by means of the at least one spring element. The lighting device may be devoid of further connection means or fixing means such as threaded connections, e.g. screws, bolts, nuts, or rivets. The mounting of the light-emitting module is therefore significantly simplified while the aforementioned disadvantages of a threaded connection can be avoided.

In another exemplary embodiment according to the invention, the spring element comprises a securing element configured to secure a connector for the light-emitting module in the clamping position. For instance, a connector may be used to connect the light-emitting module to a power source. The securing element of the spring element may be configured to prevent an undesired disconnection of the connector from the light-emitting module during use, for example by means of a form lock and/or friction lock between spring element and connector. Hence, when the spring element is used to establish a connection between light-emitting module and optical system, the connector may be secured to the light-emitting module at the same time.

In another exemplary embodiment according to the invention, the spring element and/or the light-emitting module comprises fixing means for preassembly of the spring element to the light-emitting module. For example, the spring element and the light-emitting module may comprise elements that engage with each other such as spring section(s) and recess(es). The fixing means are in particular configured to provide a releasable connection of spring element and light-emitting module to facilitate a pre-assembly of the spring element on the light-emitting module before installation on the optical system. Optionally, the fixing means may also contribute to hold the spring element in the clamping position when the light-emitting module is installed in the optical system and may for instance prevent a rotation of the spring element out of the clamping position due to torsional forces.

The lighting device according to the invention may in particular be configured for a use in automotive lighting, e.g. as automotive headlight or automotive rear light.

The features and example embodiments of the invention described above may equally pertain to the different aspects according to the present invention. In particular, with the disclosure of features relating to the lighting device according to the first aspect, also corresponding features relating to the method according to the second aspect are disclosed.

It is to be understood that the presentation of embodiments of the invention is merely exemplary and non-limiting.

Other features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not drawn to scale and that they are merely intended to conceptually illustrate the structures and procedures described herein.

BRIEF DESCRIPTION OF THE DRAWINGS

Examples of the invention will now be described in detail with reference to the accompanying drawings, in which.

DETAILED DESCRIPTION OF THE EMBODIMENTS

Figure 1:
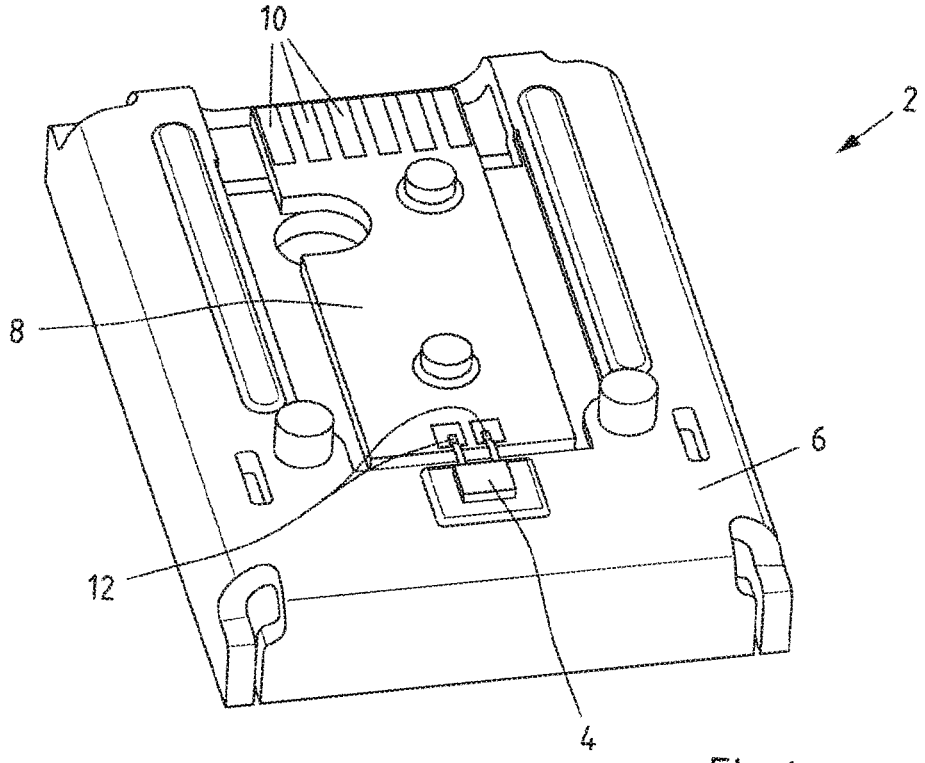
FIG. 1 shows a schematic representation of a light-emitting module for a lighting device according to the invention in a perspective view.

FIG. 1 shows a schematic representation of a light-emitting module 2 for the lighting device according to the invention in a perspective view. The light-emitting module 2 comprises a light-emitting element 4 mounted on a carrier material 6, which carrier material 6 is configured as a heat sink for the light-emitting element 4. The light-emitting element 4 comprises an LED. A circuit board 8 is provided, which provides electrical connection between the light-emitting element 4 and contact patches 10 by means of conductors 12. The contact patches 10 may be contacted by an electrical connector or socket (not shown) to provide external power to the light-emitting module 2.

Light-emitting modules 2 as shown in FIG. 1 may be replaceable modules that are mounted and fixed to an optical system of a lighting device, such as for example a reflector system and/or lens system of an automotive headlight or taillight.

Figure 2:
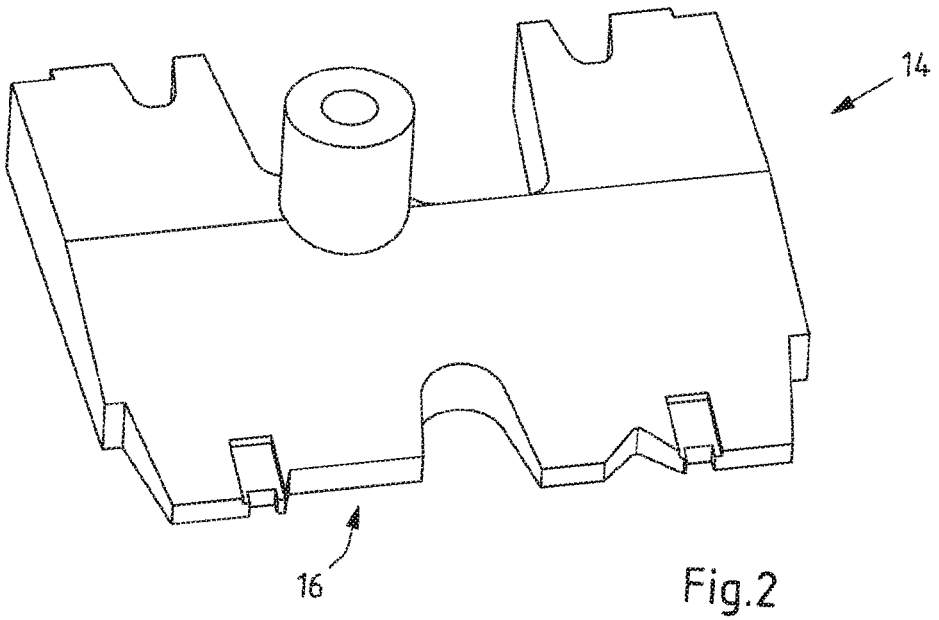
FIG. 2 shows a schematic representation of a frame of an optical system for the lighting device according to the invention in a perspective view.

FIG. 2 shows a schematic representation of a frame 14 of such an optical system for the lighting device according to the invention in a perspective view. Further details of the optical system are omitted in the drawing. The optical system may however comprise primary and secondary optical elements for shaping the light emitted by the light-emitting module 2 into a beam with a predetermined beam shape and intensity distribution. The frame 14 serves as a fixed reference point for the light-emitting module 2 in the optical system.

Figure 3:
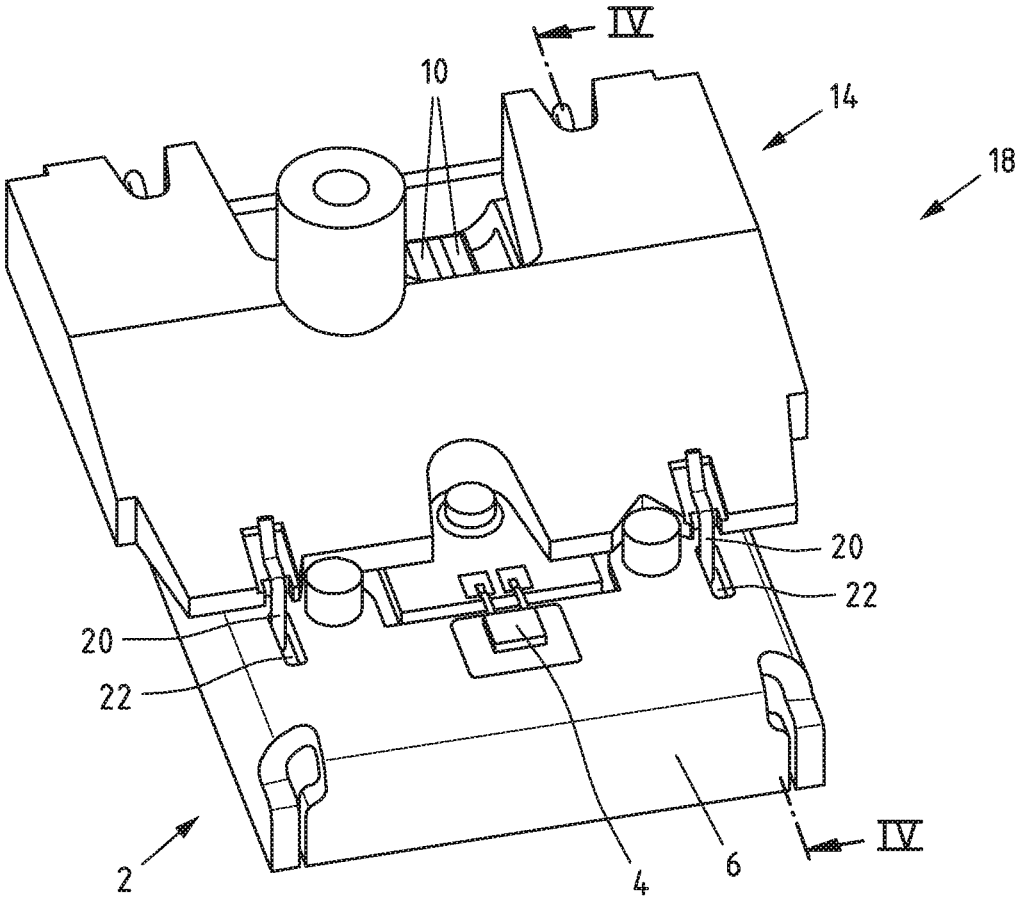
FIG. 3 shows a schematic representation of a first embodiment of the lighting device in a perspective view.

The frame 14 has a first reference face 16 configured to accommodate the light-emitting module 2 in that the first reference face 16 may be brought into contact to the surface of the circuit board 8 and/or sections of the carrier material 6. Accordingly, FIG. 3 shows a schematic representation of a first embodiment of an inventive lighting device 18 in a perspective view, wherein the lighting device 18 comprises the light-emitting module 2 of FIG. 1 and the optical system with the frame 14 of FIG. 2. Here, the first reference face 16 accommodates the light-emitting module 2.

Further, a spring element 20 for fixing the light-emitting module 2 to the frame 14 of the optical system is provided. The spring element 20 partially reaches through through-holes 22 in the carrier material 6 of the light-emitting module 2.

Figure 4A:
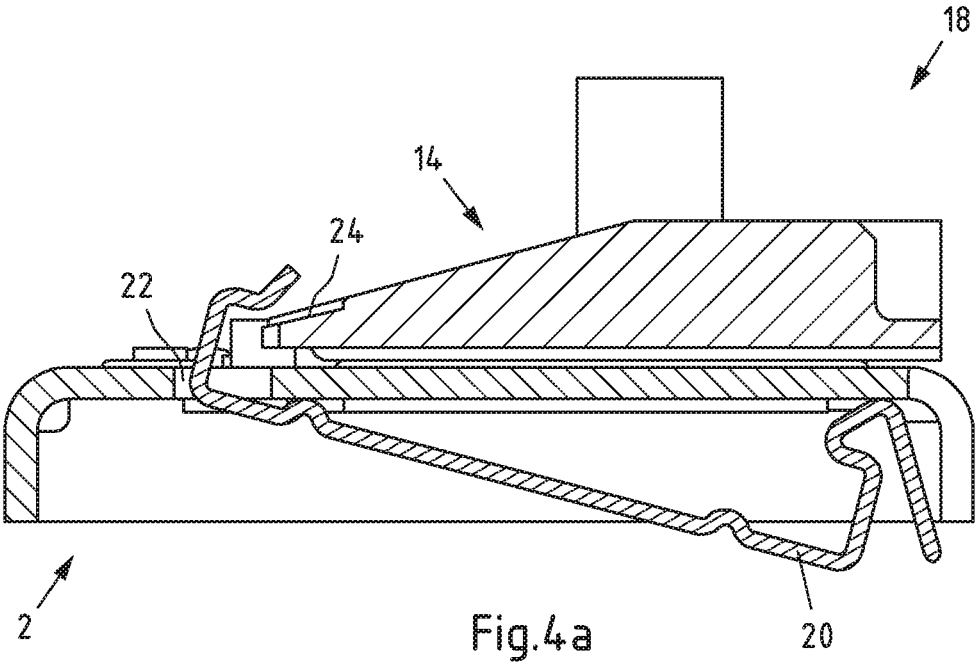
FIGS. 4*a, b* show a schematic representation of the first embodiment of the lighting device in a sectional view, with a spring element being in the insertion position and clamping position, respectively.

FIG. 4*a* shows a schematic representation of the first embodiment of the lighting device 18 in a sectional view along the line Iv-Iv of FIG. 3. The spring element 20 is shown in an insertion position, wherein a section of the spring element 20 reaches through through-hole 22 and is arranged at a pivot point 24 of the frame 14 of the optical system. In the insertion position, the spring element 20 is in a configuration without tension.

Figure 4B:
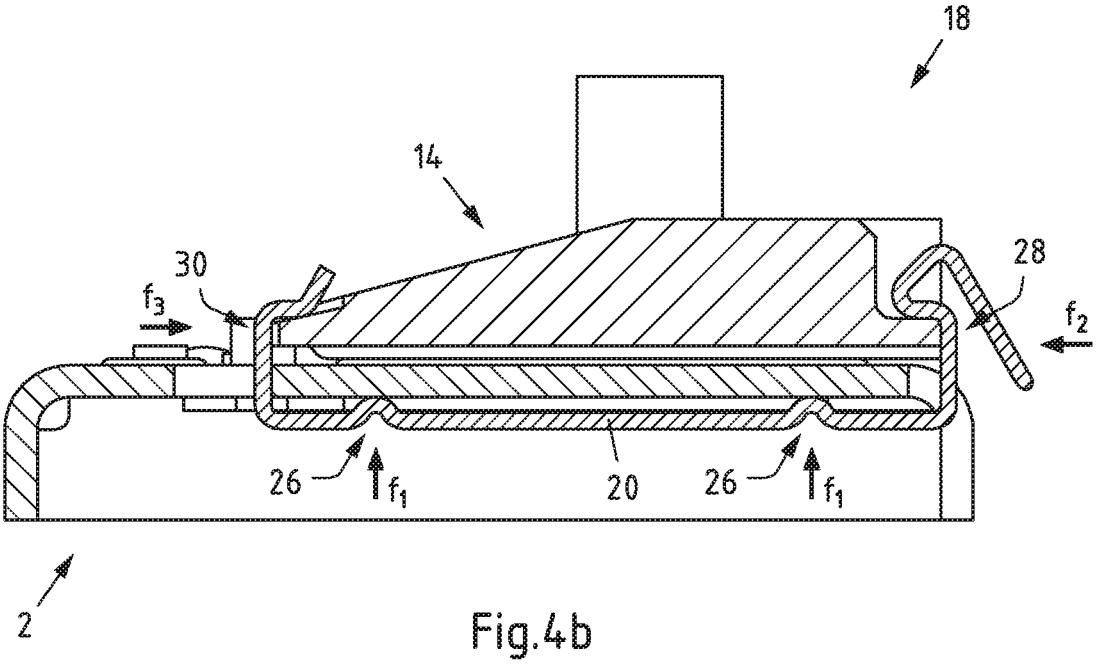

From the insertion position shown in FIG. 4*a*, the spring element 20 is rotated around the pivot point 24 into a clamping position as depicted in FIG. 4*b*. In the clamping position, first spring sections 26 of the spring element 20 exert a spring force in a first spatial direction $f_1$ towards the first reference face 16. In total, four first spring sections 26 are provided, with two first spring sections 26 being visible in FIG. 4*b*.

The spring element 20 comprises second spring sections 28 that exert a spring force towards a second spatial direction $f_2$ in the clamping position. Further, the spring element 20 comprises third spring sections 30 that exert a spring force towards a third spatial direction $f_3$ in the clamping position. The third spatial direction $f_3$ is aligned substantially antiparallel to the second spatial direction $f_2$.

The first reference face 16 is oriented substantially parallel to a light-emitting face of the light-emitting module 2, and as the spring force towards the first spatial direction $f_1$ presses the light-emitting module 2 into contact with the light-emitting face 16, the height of the light-emitting module 2 and the position of the light-emitting element 4 relative to the frame 14 is aligned. The second spatial direction $f_2$ is different from the first spatial direction $f_1$ in that the first spatial direction $f_1$ and the second spatial direction $f_2$ are oriented substantially perpendicular to each other. Hence, the spring element 20 fixes the light-emitting module 2 along two different spatial directions $f_1$ and $f_2$. By means of the opposing spring forces along the second spatial direction $f_2$ and the third spatial direction $f_3$, the spring element 20 also fixes the light-emitting module in a lateral direction.

With the light-emitting module 2 being fixed in two spatial directions $f_1$ and $f_2$ on the frame 14 of the optical system by means of the spring element 20, a reliable positioning of the light-emitting module 2 may be obtained and conventional fixing means such as screws or rivets may be omitted. As the position of the light-emitting module 2 is controlled along at least two spatial directions $f_1$ and $f_2$ by spring forces, the positioning of the light-emitting module 2 is also less sensitive to displacements and/or distortions due to thermal effects.

A second embodiment of a lighting device 18 is now described in conjunction with FIGS. 5 to 8. The same reference numerals as in FIGS. 1 to 4 have been used for corresponding elements.

Figure 5:
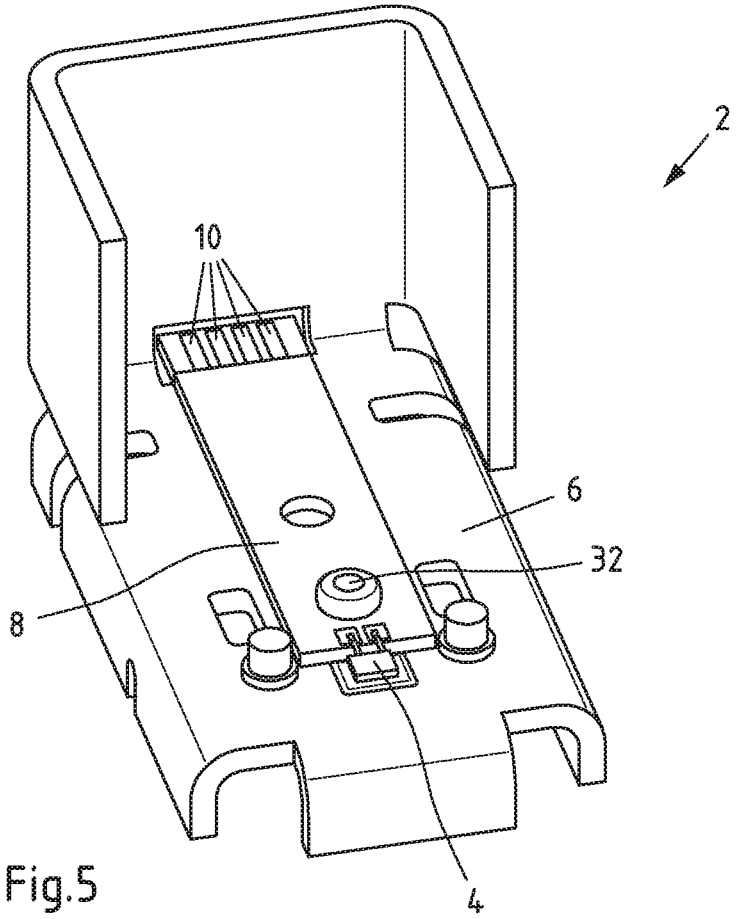
FIG. 5 shows a schematic representation of a light-emitting module for a lighting device according to the invention in a perspective view.
Figure 6:
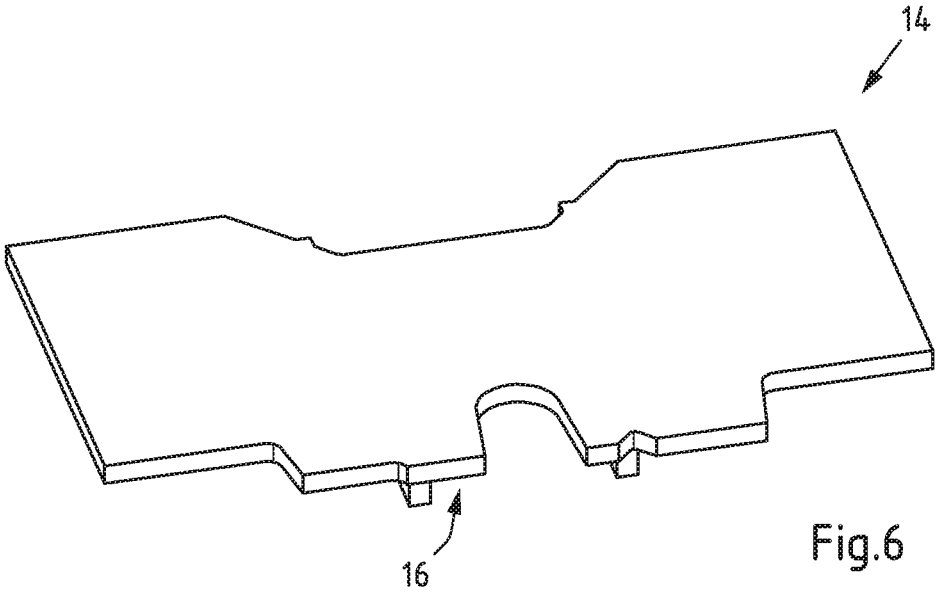
FIG. 6 shows a schematic representation of a frame of an optical system for the lighting device according to the invention in a perspective view.

FIG. 5 shows a schematic representation of a light-emitting module 2 for the lighting device according to the invention in a perspective view. The light-emitting module 2 comprises a light-emitting element 4 mounted on a carrier material 6 configured as a heat sink and a circuit board 8 for electrical connection. The circuit board 8 is fixed to the carrier material 6 by means of a screw 32. FIG. 6 shows a schematic representation of a corresponding frame 14 of an optical system with a first reference face 16 for accommodating the light-emitting module 2.

Figure 7:
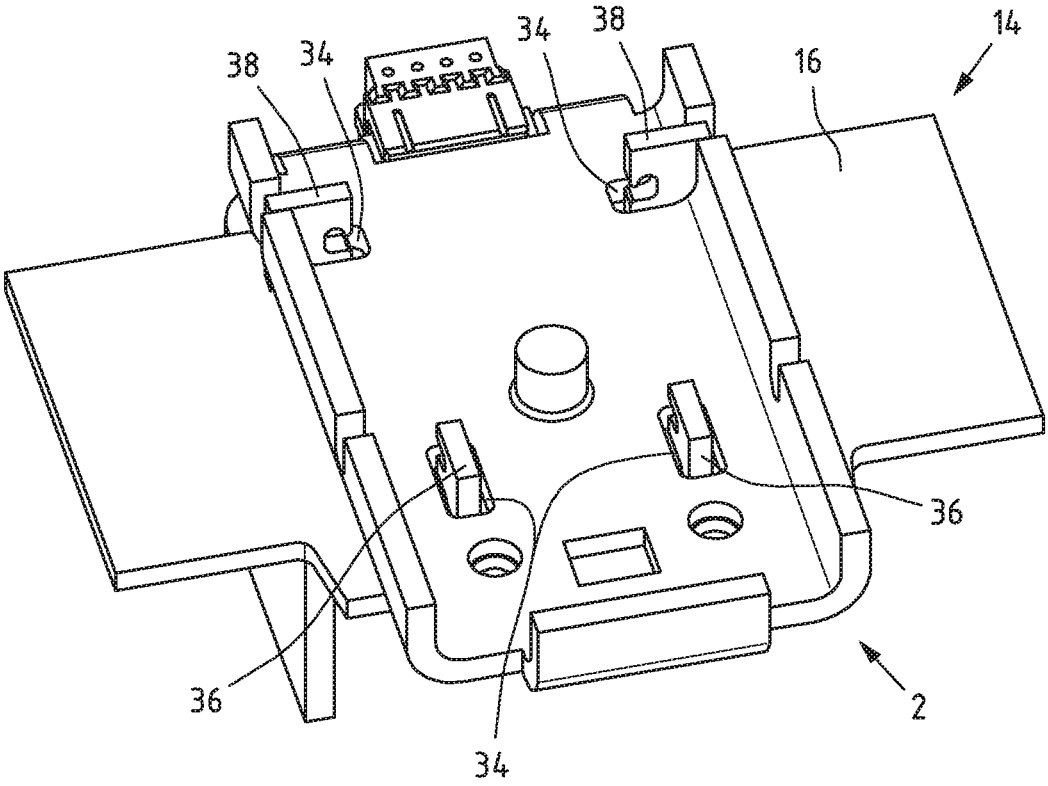
FIG. 7 shows a schematic representation of the light-emitting module of FIG. 5 arranged on a frame of an optical system of FIG. 6 in a perspective view.

As illustrated in FIG. 7, the light-emitting module 2 of FIG. 5 can be arranged on the frame 14 of FIG. 6, wherein a surface of the circuit board 8 and/or other referencing features of carrier material 6 are in contact to the first reference face 16. The carrier material 6 of the light-emitting module 2 comprises through-holes 34 and the frame 14 comprises mounting elements 36, 38 at the first reference face 16. The mounting elements 36, 38 are formed as protrusions and engage the through-holes 34 when the light-emitting module 2 is mounted to the optical system.

Each of the mounting elements 36, 38 comprises a receptacle for the spring element 20. As can be seen from FIG. 8*a*, which shows an insertion position of the spring element 20 in a perspective view, the spring element 20 may be inserted into the receptacles of the mounting elements 36, which receptacles also serve as pivot points 24 of the frame 14 of the optical system.

Figure 8A:
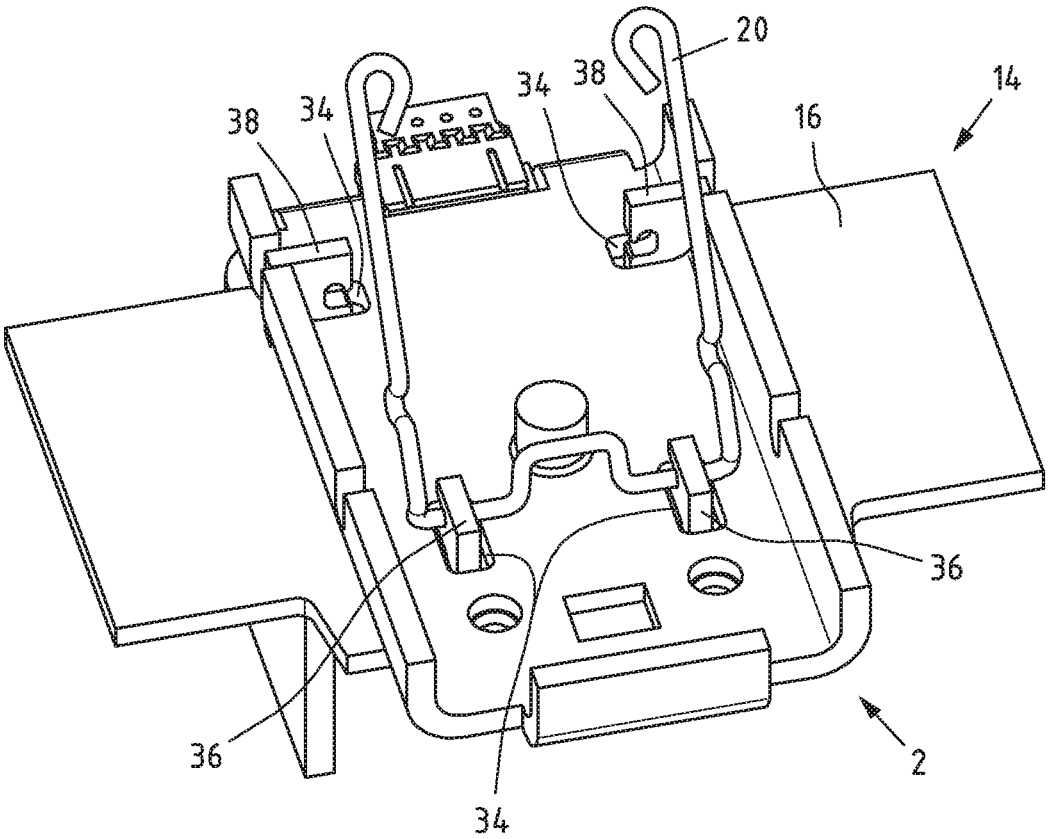
FIGS. 8*a, b* show a schematic representation of the second embodiment of the lighting device in a perspective view, with a spring element being in the insertion position and clamping position, respectively.
Figure 8B:
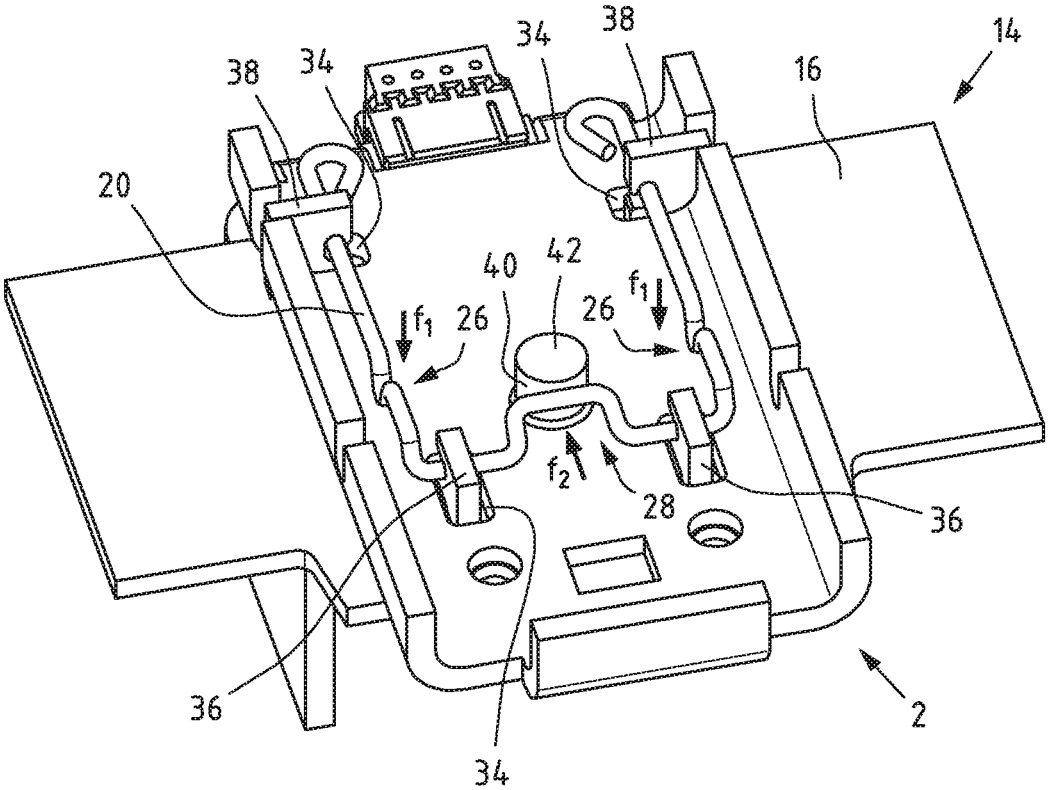

The spring element 20 is rotated around the pivot points 24, i.e., the receptacles of the mounting elements 36, from the insertion position into the clamping position shown in FIG. 8*b*. The spring element 20 is locked on the frame 14 of the optical system in receptacles of the mounting elements 38 by a spring force.

The spring element 20 comprises first spring sections 26 exerting a spring force in a first spatial direction $f_1$ towards the first reference face 16, such that the light-emitting module 2 is pressed into contact with the first reference face 16, wherein the height of the light-emitting module 2 and the position of the light-emitting element 4 is aligned. Further, the spring element 20 comprises a second spring section 28 that exerts a spring force towards a second spatial direction $f_2$. A second reference face 40 is provided on a circumferential face of a protrusion 42 of the carrier material 6, wherein the second spring section 28 is in contact to the second reference face 40.

The first spatial direction $f_1$ and the second spatial direction $f_2$ are oriented substantially perpendicular to each other, such that in addition to the aforementioned definition of the height of the light-emitting module by means of the first spring sections 26, the light-emitting module is also positioned laterally by the second spring section 28.

A third embodiment of a lighting device 18 is now described in conjunction with FIGS. 9 and 10, wherein again the same reference numerals have been used for corresponding elements as in the preceding figures.

Figure 9:
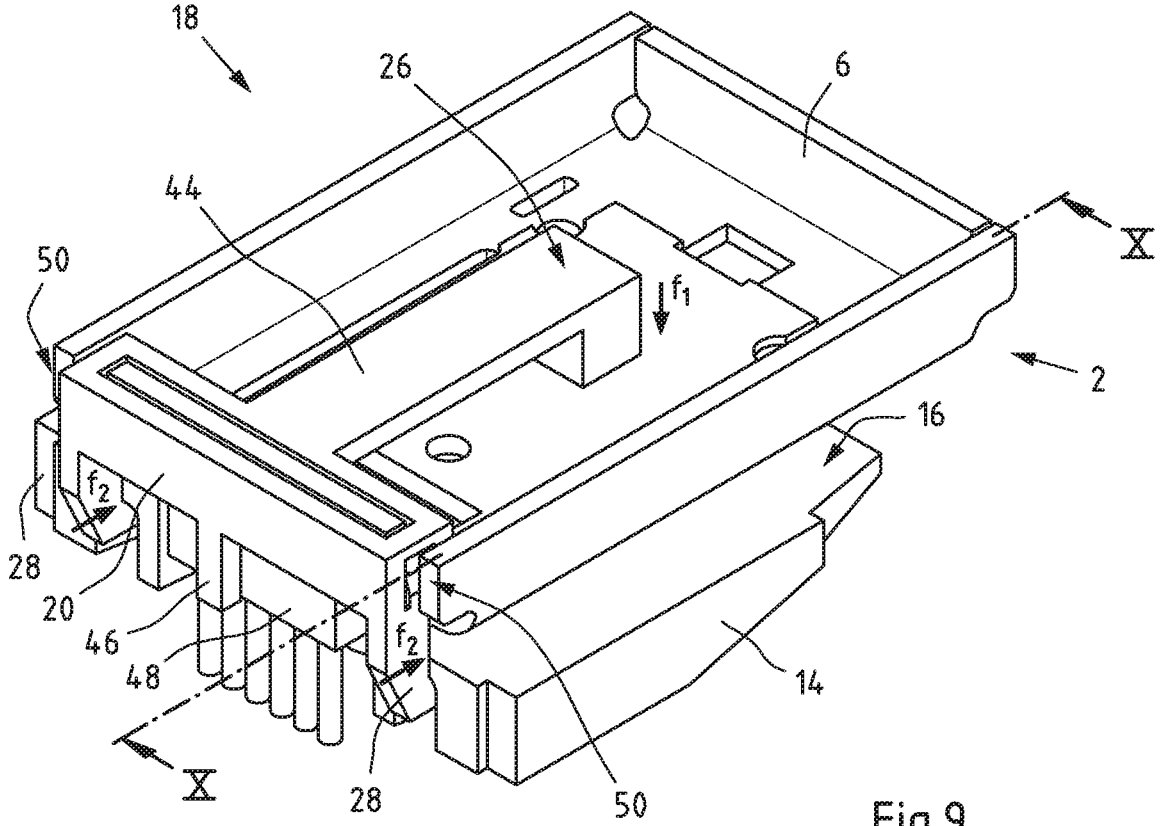
FIG. 9 shows a schematic representation of the third embodiment of the lighting device in a perspective view.

FIG. 9 shows a schematic representation of the third embodiment of the lighting device 18 in a perspective view, wherein the lighting device 18 comprises a light-emitting module 2 similar to the one shown in FIG. 1 and a frame 14 of an optical system similar to the one shown in FIG. 2. While the spring elements of the first and second embodiments may for example be formed from metal and in particular of metallic wire material, the spring element 20 of the third embodiment may be formed from a bulk material and in particular from a plastics material.

The spring element 20 comprises a leg portion 44 that forms the first spring section 26 to exert a spring force in a first spatial direction $f_1$ towards the first reference face 16. A second spring section 28 is configured to exert a spring force towards a second spatial direction $f_2$.

Further, the spring element 20 comprises a securing element 46 arranged to secure a connector 48 that is plugged into the circuit board 8 of the light-emitting module 2, the connector providing a power connection to the light-emitting module 2. The spring element 20 with the securing element 46 for the connector 48 therefore also prevents an undesired disconnection of the connector 48 from the light-emitting module 2 during use.

The spring element 20 comprises fixing means 50 for fixing the spring element 20 to the light-emitting module 2 by means of a releasable mechanical connection to the carrier material 6. The fixing means 50 may be used to preassemble the spring element 20 to the light-emitting module 2 before the light-emitting module 2 is arranged on the frame 14. Further, the fixing means 50 may contribute to stabilizing the arrangement of the spring element 20 on the light-emitting module 2 and may in particular be configured to prevent a release of the spring element 20 due to torsional forces arising from the first spring section 26 and second spring section 28. By way of example, the fixing means may be configured as a spring section as shown in FIG. 9, which may additionally engage into a recess on the carrier material 6.

Figure 10:
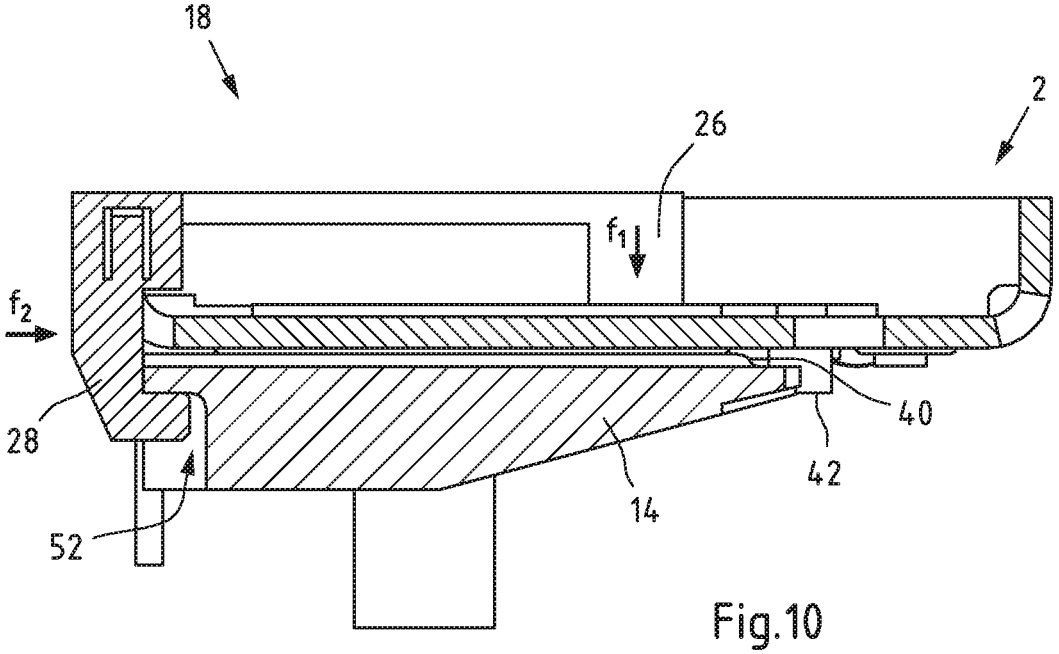
FIG. 10 shows a schematic representation of the third embodiment of the lighting device in a sectional view.

As can be seen in particular from the sectional view of FIG. 10, the spring element 20 with the second spring section 28 reaches into a recess 52 of the frame 14. A second reference face 40 is provided on a protrusion 42 formed on the carrier material 6. In this case, the second spring section exerts a spring force towards the second spatial direction $f_2$ to press the second reference face 40 into contact to the frame 14.

In the first and second embodiments of the lighting device, the light-emitting module 2 is fixed to the optical system only by means of the at least one spring element 20. Additional connection means between the light-emitting module 2 and the frame 14 may be omitted.

LIST OF REFERENCE SIGNS

2 light-emitting module
4 light-emitting element
6 carrier material
8 circuit board
10 contact patches
12 conductors
14 frame
16 first reference face
18 lighting device
20 spring element
22 through-hole
24 pivot point
26 first spring section
28 second spring section
30 third spring section
32 screw
34 through-holes
36, 38 mounting elements
40 second reference face
42 Protrusion
44 leg portion
46 securing element
48 connector
50 fixing means
52 recess
$f_1$ first spatial direction
$f_2$ second spatial direction
$f_3$ third spatial direction

The invention claimed is:

1. A lighting device comprising:

a light-emitting module;

an optical system including a first reference face structurally arranged so as to engage the light-emitting module; and a spring element structurally arranged so as to secure together the light-emitting module and the optical system in a clamped arrangement with the light-emitting module urged against the first reference face by the spring element, the spring element including first, second, and third spring sections of a single spring element that are arranged to exert spring force in respective first, second, and third spatial directions, the first spatial direction being directed toward the first reference face in the clamped arrangement, the second spatial direction being neither parallel nor antiparallel to the first spatial direction, and the third spatial direction having a non-zero component perpendicular to a plane defined by the first and second spatial directions.

2. The device of claim 1, at least two of the first, second, and third spatial directions being oriented perpendicular to one another.

3. The device of claim 1, the first, second, and third spatial directions forming a mutually orthogonal arrangement.

4. The device of claim 1, one or both of the light-emitting module or the optical system including a second reference face structurally arranged so as to engage structurally the spring element, and the second spatial direction being directed toward the second reference face in the clamped arrangement.

5. The device of claim 4, one or both of the light-emitting module or the optical system including a third reference face structurally arranged so as to engage structurally the spring element, and the third spatial direction being directed toward the third reference face in the clamped arrangement.

6. The device of claim 1, the first reference face being parallel to a light-emitting face of the light-emitting module.

7. The device of claim 1, the light-emitting module including at least one through-hole, the optical system including at least one mounting element, and the at least one mounting element being structurally arranged so as to engage the at least one through-hole in the clamped arrangement.

8. The device of claim 7, the at least one mounting element including a receptacle structurally arranged so as to receive and retain the spring element.

9. The device of claim 1, the spring element being structurally arranged so as to be locked on the light-emitting module or on the optical system.

10. The device of claim 1, the spring element being rotatably engaged with a pivot point on the optical system and rotatable about the pivot point between an insertion position and a clamping position.

11. The device of claim 1, the light-emitting module including at least one light-emitting diode and a heat sink.

12. The device of claim 1, the light-emitting module and the optical system being secured together in the clamped arrangement by only a single spring element.

13. The device of claim 1, the spring element being elastically deformable.

14. The device of claim 1, the spring element being plastically deformable.

15. The device of claim 1, the spring element including a securing element structurally arranged so as to secure a connector for the light-emitting module in the clamped arrangement.

16. The device of claim 1, the spring element being preassembled with the light-emitting module.

17. A method for securing a light-emitting module to an optical system, the method comprising:

positioning the light-emitting module against a first reference face of the optical system, the first reference face being structurally arranged so as to engage the light-emitting module; and using a spring element structurally arranged therefor, securing together the light-emitting module and the optical system in a clamped arrangement with the light-emitting module urged against the first reference face by the spring element, the spring element including first, second, and third spring sections of a single spring element that are arranged to exert spring force in respective first, second, and third spatial directions, the first spatial direction being directed toward the first reference face in the clamped arrangement, the second spatial direction being neither parallel nor antiparallel to the first spatial direction, and the third spatial direction having a non-zero component perpendicular to a plane defined by the first and second spatial directions.

18. The method of claim 17, the first, second, and third spatial directions forming a mutually orthogonal arrangement.

19. The method of claim 17, the light-emitting module including at least one light-emitting diode and a heat sink.

20. The method of claim 17, the light-emitting module and the optical system being secured together in the clamped arrangement by only a single spring element.

* * * * *